United States Patent [19]

Furniss et al.

[11] 4,004,522

[45] Jan. 25, 1977

[54] SHOT SHELL WADDING

[75] Inventors: Harry Furniss, Oldham; Jack Grindrod, Royton, Oldham, both of England

[73] Assignee: Unit Wad Limited, Werneth, Oldham, England

[22] Filed: Sept. 26, 1974

[21] Appl. No.: 509,690

[52] U.S. Cl. ..... 102/95; 102/42 C

[51] Int. Cl.[2] ..... F42B 7/08

[58] Field of Search ..... 102/42 C, 95

[56] References Cited

UNITED STATES PATENTS

| | | | |
|---|---|---|---|
| 3,289,586 | 12/1966 | Horn et al. | 102/95 |
| 3,402,664 | 9/1968 | Cramer | 102/42 C |
| 3,707,915 | 1/1973 | Kerzman | 102/42 C |
| 3,727,557 | 4/1973 | Starcevich | 102/95 |

*Primary Examiner*—Verlin R. Pendegrass
*Attorney, Agent, or Firm*—Pearson & Pearson

[57] ABSTRACT

A shot/shell wadding for a shotgun cartridge wherein a progressively collapsible connection is provided between a charge-containing cup and a shot-containing cup, the said connection including co-operable elements which move into frictional engagement on initial collapse of the connection and exert an increasing resistance to relative motion between the charge-containing and shot-containing cups on continued collapse of the connection.

8 Claims, 2 Drawing Figures

SHOT SHELL WADDING

Figure 1:
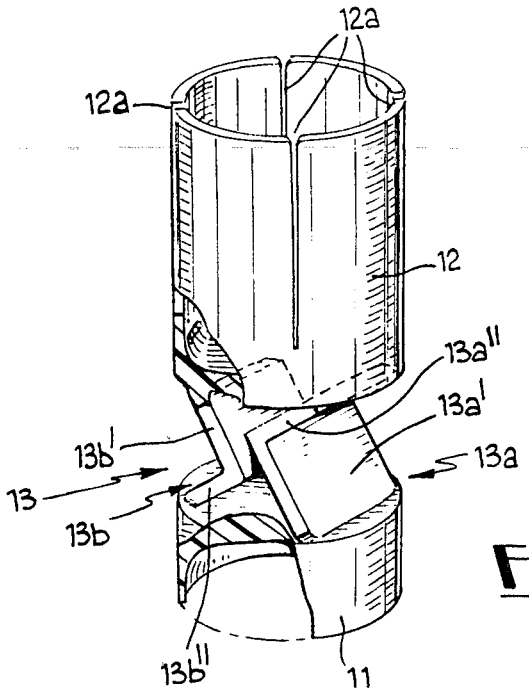

This invention concerns shot gun cartridges and has particular reference to a shot/shell wadding therefor.

In order to provide for a controlled and regular distribution of shot issuing from the barrel of a shot gun on the discharge thereof it is required that the impulse from the detonation of the explosive propellant be applied progressively and smoothly to the wadding, and hence to the shot.

A variety of shot/shell waddings have been proposed for achieving this end, the different waddings embodying a progressively collapsible connection between a charge-containing cup and a shot-containing cup and each being characterised by a respective and unique form of connection between such cups. Thus, it is known to provide a wadding comprising a generally cylindrical body having oppositely directed charge-containing and shot-containing cups at the respective ends thereof, the bases of the two cups being spaced axially of the body to give a cylindrical shell which is intended to buckle on ignition of the powder to give a progressive application of the propulsive force to the wadding. In one commercial form of wadding the cylindrical shell which exists between the bases of the two cups is slitted in the axial direction of the wadding to give a plurality of side-by-side limbs connecting the opposed ends of the wadding, the limbs being crimped radially inwardly to a slight degree to give a start to a buckling of such limbs on powder ignition and to initiate the direction of the collapse. In another commercial form of wadding the cylindrical shell is provided with a plurality of apertures therein in spaced disposition peripherally of the shell, the apertures being of oval shape with the major axis thereof arranged in the axial direction of the wadding and such apertures defining collapsible limbs between successive ones thereof.

The primary object of the present invention is to provide an alternative to the shot/shell waddings as commercially available which will give a smoother progressive application of the propulsive force of the ignited powder of a more readily reproducible kind than has been possible hithertofore.

According to the present invention we propose a shot/shell wadding having a charge-containing cup, a shot-containing cup and a collapsible connection means between such cups which is characterised in that the said connection means comprises a plurality of elements adapted and arranged for surface engagement with an adjacent element upon initial collapse to provide a frictional resistance to relative motion therebetween thereafter.

According to a further feature the elements are provided in pairs, each such element being of cranked form and there being opposed surfaces on the respective elements of a pair adapted to be moved into frictional engagement on progressive collapse of such elements.

According to a preferred feature of the invention a single pair of elements is provided, such elements being directed transversely of the wadding and being symmetrically arranged with respect to the diameter thereof.

Figure 2:
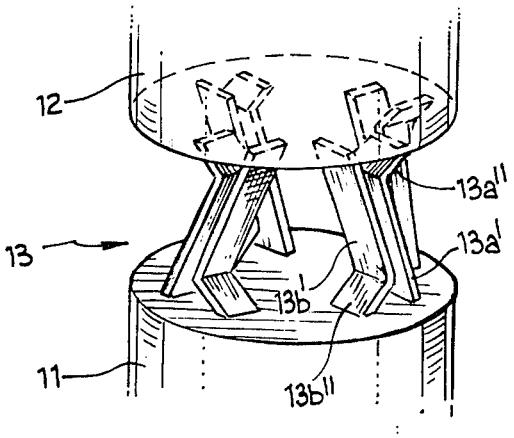

The invention will now be described further, by way of example only, with reference to the accompanying drawings illustrating two embodiments thereof and in which:

FIG. 1 is a perspective view, partly broken away, of a preferred embodiment; and FIG. 2 is a perspective view of a part of a second embodiment and shows the connection means between the charge-containing cup and the shot-containing cup.

Referring now to the drawing, and particularly to FIG. 1 thereof, a shot/shell wadding for a shotgun cartridge comprises cylindrical charge-containing and shot-containing cups 11,12 respectively, arranged in opposed coaxial disposition and joined together by a collapsible connection means 13.

The wadding is of integrally moulded construction, and the preferred material of choice is low density polythene. Other materials may be used, if preferred.

The charge-containing cup 11 and the shot-containing cup 12 are of a like diameter, and the wall of the latter is provided with four slots **12*a* arranged at 90° intervals about the periphery thereof. The collapsible connection means 13 consists of two cranked elements 13*a*,13*b* arranged in opposed co-operable relationship, the said elements being arranged parallel and in opposed symmetrical disposition relative to a diameter of the wadding. Each element 13*a*,13*b* has a relatively long limb, 13*a*′,13*b*′, and a relatively short limb, 13*a*′λ′,13*b*″, the longer limbs 13*a*′,13*b*′** being in spaced parallel disposition as is readily apparent from the drawing, and being substantially at right angles to the related shorter limbs.

In operation, a motion of the charge-containing cup 11 resulting from powder ignition will be transmitted to the shot-containing cup 12 through the connection means 13. Having regard to the nature of the connection means, the impulse as applied to the charge-containing cup will be applied smoothly and progressively to the shot-containing cup, the cranked elements **13*a*,13*b* cushioning the impulse initially as the opposed surfaces of the longer limbs 13*a*′,13*b*′ move towards and into contact, and thereafter transmitting a progressively heavier impulse to the shot-containing cup 12 as the frictional resistance to relative movement between the engaged opposed surfaces of the limbs 13*a*′,13*b*′ increases, the connection means 13** eventually locking solid to transmit the whole of the impulse of the charge-containing cup to the shot-containing cup.

In an alternative embodiment, see now FIG. 2, a plurality of pairs of co-operating cranked elements 13 is provided in angularly spaced disposition peripherally of the wadding, successive pairs being oppositely disposed as can be seen from the drawing. The form and co-operation of the individual elements of each pair is similar to the embodiment described in connection with FIG. 1 and no further description is thought necessary.

By utilizing the connection means as herein proposed we are able to provide a smooth transference of a motion of the charge-containing cup to the shot-containing cup.

We believe that the transfer will be smoother than is possible in the prior art structures, in view of the non-reliance, in the case of our invention, upon buckling and compaction as a means for progressively transmitting an impulse, but rather upon a progressive frictional resistance to relative motion between elements in surface contact.

It is to be observed that when the co-operating elements of the connection means of our invention are in such frictional engagement that there is no relative movement therebetween, such elements combine to define a substantial and rigid connection between the two cups which transmits the motion in the axial direction of the cups. Such alignment of the direction in which the impulse is transmitted with the axis of the wadding is thought to be difficult to achieve, and indeed to reproduce, in prior art structures where so much reliance is placed on buckling and compaction.

The invention is not restricted to the exact features of the embodiments described, since alternatives may well present themselves to one skilled in the art.

Thus, for example, whilst we prefer to provide the wadding as an integral structure formed by injection moulding, an equivalent effect may well be achieved by providing a connection means as a separate integer for interposing between a separate charge-containing cup and shot-containing cup, the said means comprising, in this instance, the connection means as disclosed together with means appropriate to locate the same in relation to the opposed cups.

We claim:

1. A shot/shell wadding having a charge containing cup, a shot-containing cup and a collapsible connection means between such cups, characterised in that the said connection means comprises a plurality of elements each extending between the said cups and each positioned for surface engagement with a respective adjacent element of the said plurality of elements upon initial collapse of the connection means to provide an increasing frictional resistance to relative motion therebetween and a consequential increasing resistance to continuing collapse.

2. A wadding as claimed in claim 1 wherein each element comprises mutually inclined limbs in end-to-end abutting relationship, the limbs of each such element being arranged substantially at right angles to each other.

3. A wadding as claimed in claim 2 wherein the limbs of each element are of dissimilar length.

4. A wadding as claimed in claim 1 comprising an integrally moulded structure.

5. A shot/wadding having a charge-containing cup, a shot-containing cup and a collapsible connection means between such cups, characterised in that the said connection means comprises a plurality of elements positioned for surface engagement with an adjacent element upon initial collapse to provide an increasing frictional resistance to relative motion therebetween and a consequential increasing resistance to continuing collapse, the said plurality of elements being provided in pairs, each such element being of cranked form and there being opposed surfaces on the respective elements of a pair for frictional engagement on progressive collapse of such elements.

6. A wadding as claimed in claim 5 wherein the individual elements of each pair are oppositely disposed.

7. A wadding as claimed in claim 5 wherein a single pair of co-operating elements is provided, the elements of such pair being symmetrically arranged with respect to a diameter of the wadding.

8. A shot/shell wadding of the type having a charge-containing cup, a shot containing cup and a collapsible connection means between said cups, characterised in that said collapsible connection means comprises at least two elements each of cranked form, with a pair of limbs initially bent substantially at right angles to each other, each said element having an elongated surface on one said limb thereof in parallelism with a corresponding elongated surface on a said limb of the other said element;

said surfaces being in intimate frictional contact with each other, as said connection means is collapsed, and as said elements thereby move relative to each other, and producing progressively increasing frictional resistance to continuing collapse of said wadding.

* * * * *